United States Patent [19]

Sato et al.

[11] Patent Number: 4,958,806

[45] Date of Patent: Sep. 25, 1990

[54] SNOWSTORM GUARD FENCE STRUCTURES AND JET ROOFS

[75] Inventors: Akira Sato; Masatoshi Ono, both of Niigata, Japan

[73] Assignee: Nihon Samicon Co., Ltd., Japan

[21] Appl. No.: 284,310

[22] Filed: Dec. 14, 1988

[51] Int. Cl.[5] ..... E01F 7/02

[52] U.S. Cl. ..... 256/12.5; 256/13.1; 256/29; 256/19

[58] Field of Search ..... 256/12.5, 19, 25, 29, 256/30, 31, 13.1; 244/114 B

[56] References Cited

U.S. PATENT DOCUMENTS

| | | | |
|---|---|---|---|
| 731,320 | 6/1903 | Newell | 256/12.5 |
| 1,144,393 | 6/1915 | Swezey | 256/12.5 |
| 1,184,046 | 5/1916 | Swezey | 256/12.5 |
| 1,465,894 | 8/1923 | Crowley | 256/12.5 |
| 1,541,241 | 6/1925 | Baxter | 256/12.5 |
| 1,545,909 | 7/1925 | McKinnon | 256/12.5 |
| 1,749,068 | 3/1930 | De Land | 256/12.5 X |
| 1,768,974 | 7/1930 | Brown | 256/12.5 |
| 2,095,520 | 10/1937 | Fugit | 256/12.5 |
| 2,826,382 | 3/1958 | Hayden | 256/12.5 |
| 3,010,684 | 11/1961 | Phillips et al. | 256/12.5 X |
| 3,966,172 | 6/1976 | Garrett | 256/12.5 |
| 4,471,924 | 9/1984 | Lynn | 256/12.5 X |

FOREIGN PATENT DOCUMENTS

| | | | |
|---|---|---|---|
| 222827 | 1/1958 | Australia | 256/19 |

*Primary Examiner*—Andrew V. Kundrat
*Assistant Examiner*—Carol I. Bordas
*Attorney, Agent, or Firm*—J. Rodman Steele, Jr.

[57] ABSTRACT

A snowstorm guard fence structure is constructed by anchoring a wall, which overhangs at an upward slope to a road side, to a supporting wall disposed along one side of the road. The constructed structure can be placed on sides of roads, has a space to discard the snow removed from the road, and also is effective for preventing snow accumulation on the road regardless of the degree of wind velocity and the presence of shelter structures. A jet roof is constructed by disposing a plurality of props on a slant and providing a plurality of panels between the props at spaces for jet openings so that jet openings are gradually narrowed toward the road side. The constructed jet roof is effective for preventing snow accumulation on the road regardless of the condition of wind velocity and the presence of shelter structures.

14 Claims, 4 Drawing Sheets

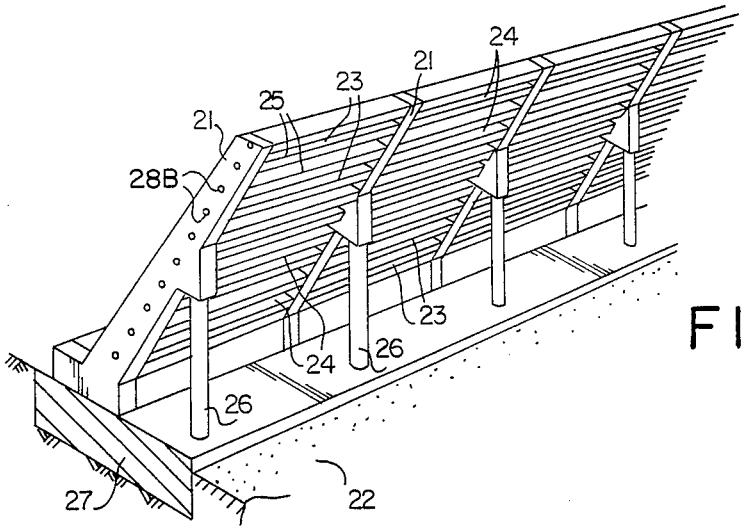
FIG. 7
FIG. 8
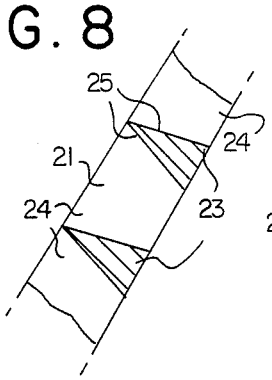
FIG. 9
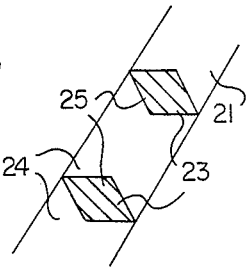
FIG. 10
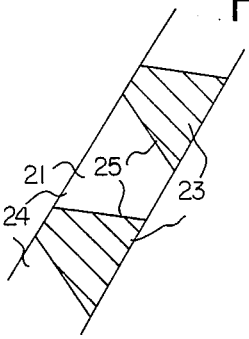
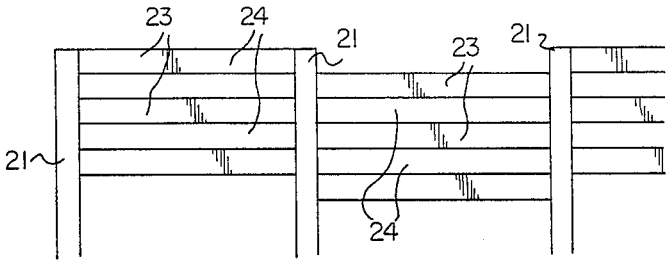
FIG. 11

SNOWSTORM GUARD FENCE STRUCTURES AND JET ROOFS

BACKGROUND OF THE INVENTION

1. Field of the Invention

This invention relates to snowstorm guard fence structures and jet roofs for preventing snow damage by snowstorms to roads ans rail tracks in areas of high snowfall.

2. Conventional Technologies

Conventional means to prevent snow damage by ground snowstorm include snow fences, jet roofs and blow-up roofs. The snow fence, which is perpendicularly disposed in a place considerably spaced from one side of a road, changes the velocity of wind to form snowdrifts artificially along the fence, thereby reducing the amount of the snow reaching the road to prevent abstruction of visibility. The jet roof is disposed on a slant in a place spaced from one side of a road, and a ground snowstorm is passed through openings formed at the lower end of this roof to increase the velocity of wind, so that the blown snow swept along the surface of the road to prevent obstruction of visibility. The blow-up roof is disposed on a slant in a place spaced from one side of a cut-down road, and the direction and velocity of wind are changed along this inclined roof, so that the snow is passed over the road to prevent obstruction of visibility.

In these conventional technologies mentioned above, as the snow fence and blow-up roof are required to be disposed in a place considerably spaced from on side of a road in order to produce satisfactory results, they can not be easily construct due to difficulty in securing sites for them. The jet roofs are ineffective when snow is piled on the side of the road, and snow removal work is difficult because there is no space to discard the snow removed from the road. Moreover, the jet roof and blow-up roof have problems in which they are effective only at high wind velocity and are also difficult to use with roads having shelter structures such as medians and guard rails thereon, said shelter structures tending to create snowdrifts.

Further, the conventional jet roof is formed with jet openings at its lower end, and by utilizing the openings wind is increased in velocity. The blow snow is scattered, to prevent obstruction of visibility.

As the above-mentioned conventinal technologies are not effective when snow is piled in the jet openings at the lower end of the fences, it is required to constantly remove the piled snow therefrom, and the presence of shelter structures such as medians and guard rails on the road disturbs the flow of wind to form snowdrifts. The conventional technologies also have little effect if the direction of wind is not nearly right-angled to the fence. There also has been a problem whereby only half the road remains unobstructed at low wind velocity.

SUMMARY OF THE INVENTION

Therefore, a first object of the present invention is to provide a snowstorm guard fence structure which can be placed on the side of a road.

A second object of this invention is to provide a snowstrom guard fence structure having a space to discard the snow removed from the road.

A third object of this invention is to provided a snowstorm guard fence structure which is effective regardless of the degree of wind velocity and the presence of shelter structures.

A fourth object of this invention is to provide a snowstorm guard fence structure applicable to cut-down roads and filled-up roads.

A fifth object of this invention is to provide a jet roof which is effective to prevent snow accumulation on the road reagardless of the condition of wind velocity and the presence of shelter structures.

A sixth object of this invention is to provide a jet roof which requires no snow removal as jet openings are never plugged even by piling snow at the lower end of the jet roof.

BRIEF DESCRIPTION OF THE DRAWINGS

FIGS. 1 to 3 illustrate a first embodiment of the snowstorm guard fence structure of this invention, of which FIG. 1 is a vertical cross sectional view, FIG. 2 is a broken front view, and FIG. 3 is a broken perspective view.

FIGS. 6 and 7 illustrate a forth embodiment of the jet roof of this invention, of which FIG. 6 is a vertical cross sectional view and FIG. 7 is a perspective view.

FIGS. 8 to 10 are cross sectional views of the essences of a fifth embodiment illustrating the jet roof of this invention.

FIG. 11 is a front view of the essence of a sixth embodiment illustrating the jet roof this invention.

DETAILED DESCRIPTION OF THE INVENTION

The embodiments of this invention are further described according to the accompanying drawings.

Figure 1:
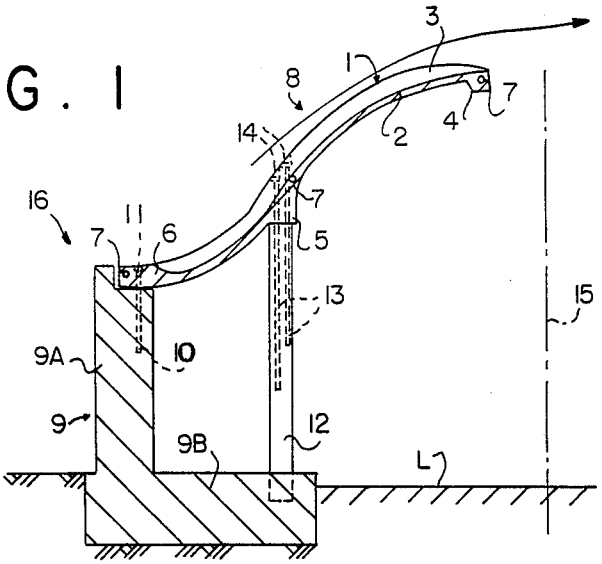
Figure 2:
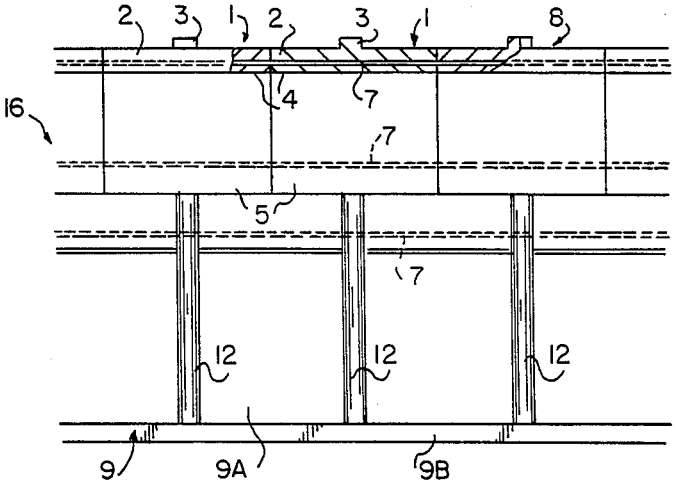
Figure 3:
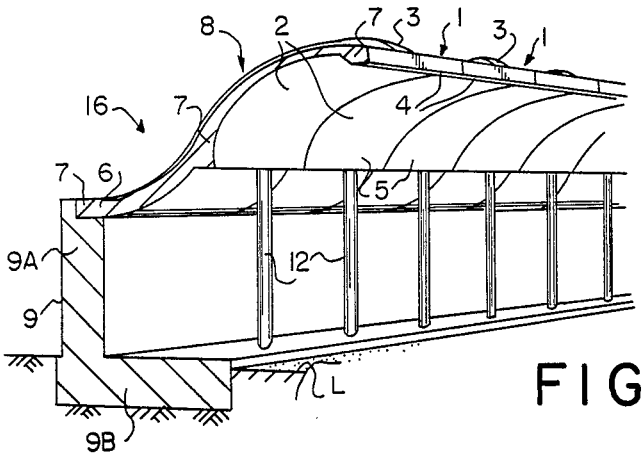

Referring to the first embodiment of the snowstorm guard fence structure of this invention, as shown in FIGS. 1 to 3, 1 is a principal beam comprising prestressed concrete of precast, or so-called PC precast concrete or RC precast concrete, said principal beam 1 being formed of a corrugated flange 2 having a nearly S-shaped side face, a rib 3 disposed on the upper surface center of the flange 2 in the transverse direction of road, and binder parts 4, 5, and 6 which are disposed on the lower surface end, about the lower surface center and the base end of the flange 2, respectively, in the longitudinal direction of road. A plurality of principal beams are disposed in a line abutting each other in the longitudinal direction of road, and monolithically wound with each of the binder parts 4, 5, and 6 by laterally clamping steel material 7 to form a prestressed wall 8.

Denoted at 9 is an L-shaped substructural pile as a supporting wall which is formed by cast-in-place concrete along one side of a road L, and said substructural pile 9 has vertically clamping steel material 10 buried therein, said steel material extending through the base end of the principal beam and being secured thereto by a binding member 11.

Denoted at 12 is a pole disposed between the binder part 5 in the center of the principal beam 1 and the substructural pile 9. The pole 12 is buried at the lower end in the sbustructural pile 9 and fixed thereto, and further has vertically clamping steel materials 13 buried therein, said steel material 12 extending through the binder part 5 and the rib 3 and being secured thereto by means of binding materials 14.

In this way, the wall 8 overhangs at an upward slope to the road L side in the condition supported by the substructural pile 9 and the pole 12, with the top of said wall 8 extending to near the one-dotted chain line 15 showing the center of the width of the road L.

As shown by the arrow in FIG. 1, the blown snows caused by ground snowstorms are led at an upward slope along the upper surface of the wall 8 to fly over the visibility range above the road.

Thus, in the above embodiment, the snowstorm guard fence structure 16 is easily constructed in a narrow space because it can be placed along one side of the road L. Further, as a space for a lateral wall 9B of the substructural pile 9 can be secured between the side end of the road L and the vertical wall 9A of the substructural pile 9, the snow removed from the road L can be discarded in this space.

The overhang of the wall 8 at an upward slope to the road L permits the blown snows caused by ground snowstorm to fly over the wall above the visibility range to produce a satisfactory effect regardless of the degree of wind velocity and the presence of shelter structures, and further the application to cut-down and filled-up roads is also possible.

Figure 4:
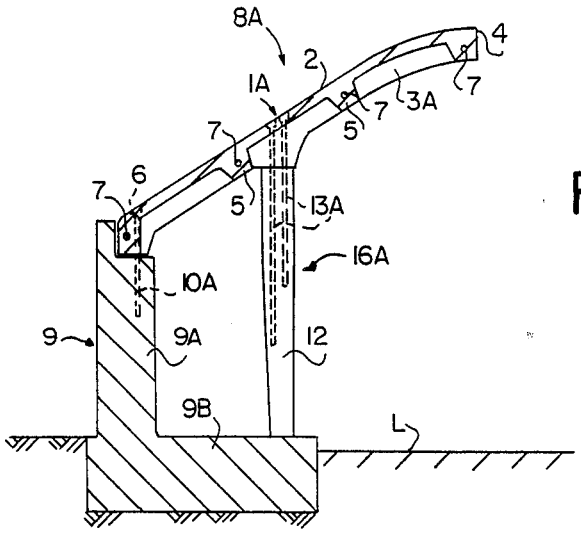
FIG. 4 is a vertical cross sectional view of a second embodiment of the snowstorm guard fence structure of this invention.

FIG. 4 illustrates the second embodiment of the snowstorm guard fence structure of this invention. In this materials 14.

In this way, the wall 8 overhangs at an upward slope to the road L side in the condition supported by the substructural pile 9 and the pole 12, with the top of said wall 8 extending to near the one-dotted chain line 15 showing the center of the wideth of the road L.

As shown by the arrow in FIG. 1, the blown snows caused by ground snowstorms are led at an upward slope along the upper surface of the wall 8 to fly over the visibility range above the road.

Thus, in the above embodiment, the snowstorm guard fence structure 16 is easily constructed in a narrow space because it can be placed along one side end of the road L. Further, as a space for a lateral wall 9B of the substructural pile 9 can be secured between the side end of the road L and the vertical wall 9A of the substructural pile 9, the snow removed from the road L can be discarded in this space.

The overhang of the wall 8 at an upward slope to the road L permits the blown snows caused by ground snowstorm to fly over the wall above the visibility range to produce a satisfactory effect ragardless of the degree of wind velocity and the presence of shelter structures, and further the application to cut-down and filled-up roads is also possible.

FIG. 4 illustrates the second embodiment of the snowstorm guard fence structure of this invention. In this embodiment, the wall 8A is formed using a nearly I-shaped principal beam 1A which has a rib 3A on its lower surface. The laterally clamping steel materials 7 and vertically clamping steel materials 10A and 13A are PC-anchored using PC steel materials. In this embodiment, also, the snwostorm guard fence structure 16A can be placed one side of the road 1, has space to discard the snow removed from the road L, and is effective regardless of the condition of the wind velocity and the presence of shelter structures.

Figure 5:
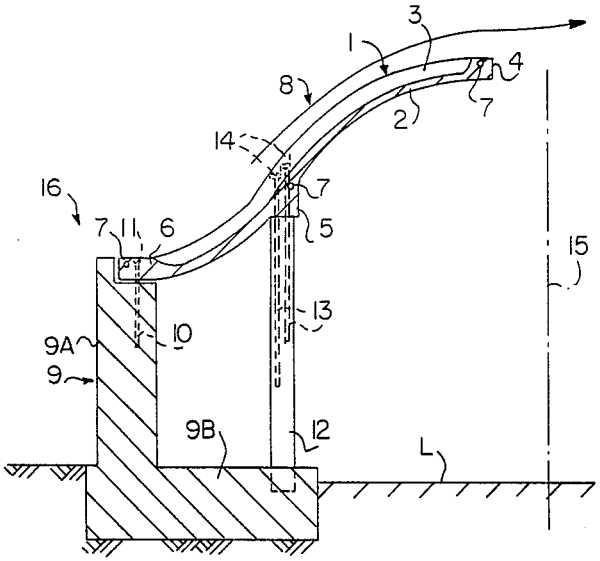
FIG. 5 is a vertical cross sectional view of a third embodiment of the snowstorm guard fence structure of this invention.

FIG. 5 illustrates the third embodiment of the snowstorm guard fence structure of this invention. In this embodiment, the binder part 4 of the snowstorm guard fence structure shown in FIGS. 1 to 3 is disposed at the top of the upper surface of the flange 2 on the principal beam 1, whereby the blown snows caused by ground snowstorm are led upward due to the binder part 4 as shwon by the arrow of FIG. 5, to prevent the snow from flying under the lower surface end of the flange 2.

Figure 6:
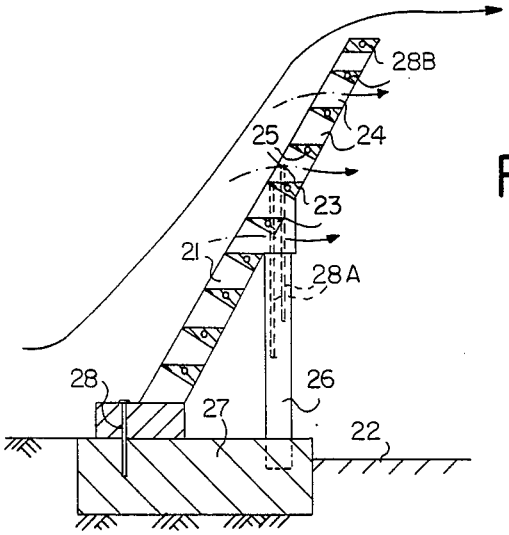

FIGS. 6 and 7 illustrate the fourth embodiment of the jet roof of this invention. In the same figures, denoted at 21 is a prop disposed on a slant at fixed intervals an one side of a road 22 or a rail track, and between adjacent props 21, a plurality of precast pannel 23 are provided in plural tires and spaced for jet openings 24 by suitable fastening means.

The pannel 23 has a chevron structure whose sectional form is nearly right-angled triangle having one slant surface 25, and the jet opening 24 between adjacent pannels 23 has a trapezoidal sectional form narrowing toward the road 22 side.

The sectional form of the pannel 23 may be a chevron structure having at least one slant surface 25, and may be suitably selected from a chevron structure comprising an equilateral triangle as shown in FIG. 8, a rhombic form as shown in FIG. 9, and a trapezoidal form as shown in FIG. 10. Two slant surfaces of the triangle part may have different angles.

The pannel 23 may be provided so that the jet openings 24 are formed straightly along the road 22 as shown in FIG. 7, or so that the jet openings 24 are alternately formed as shown in FIG. 11.

The props 21 are disposed on a slant so as to incline gradually to the road 22 side as extending upward, and the pannel 23 provided in plural tires between these props 21 are arranged in parallel in the slanted direction.

The props 21 and pannels 23 may be suitably formed by concretes such as PC precast concrete.

Denoted at 26 and 27 are a stay post and a foundation pile, respectively, and the lower end of the prop 21 is anchored to this foundation pile 27 by means of anchoring steel materials 28, and the lower end of the stay post 26 is also buried in the foundation pile 27 and supported thereby. The nearly center part of the prop 21 is anchored to the upper end of the stay post 26 by means of anchoring steel material 28A, and each of the pannels 23 is anchored to the prop 21 by anchoring steel materials 28B. The anchoring steel materials 28, 28A, and 28B may be suitably selected from steel bars, steel wires, anchor bolts, nuts, and PC steel materials.

Accordingly, in the above embodiment, plural tires of pannel 23 are provided in parallel between adjacent props 21 disposed on a slant to the road 22 side at spaces for jet openings 24, whereby under conditions of high wind velocity, the blown snow goes up in the slant direction of the prop 21 as shown by the arrow of actual line in FIG. 6 to be blown up over the upper end of the jet roof across the road 22.

On the other hand, under conditions of low wind velocity, as shown by the arrow of one-dotted chain line, the blown snow is dispersed through plural tires of jet openings 24 and gathered due to the shape of jet opening 24 which narrow toward the road 22 side, thereby increasing the velocity of wind to scatter the snows with a wide flying range.

Accordingly, a satisfactory effect on snow removal can be obtained, regardless of the degree of wind velocity, to prevent obstruction of visibility. Also, the jet openings 24 are never plugged even by piling snow at the lower end of the jet roof, so that removal of the piled snow is not required. Furthermore, the snow is blown up above the jet roof at high wind velocity, and gathered and dispersed through plural tires of jet opening 24 to fly for a long distance at low wind velocity. Therefore, a sufficient effect on snow removal can be abtained even on roads having shelter structures such as medians and guard rails.

This invention is not limited by the above mentioned embodiments, and various modifications can be made within the range of the gist of this invention. For example, in the snowstorm guard fence structure, the form of the wall, the number and situation of the beams, or the overhanging length to the road of the wall may be suitably selected. Also in the jet roof, the pannels and poles may be made by synthetic resins and steels as well as concretes,

What is claimed is:

1. A snow fence to be disposed along the side of a road and the like, comprising:

an L-shaped substructural pile having a forward horizontal part, a rearward horizontal part, an upper vertical part, and a lower vertical part, said forward horizontal part being disposed closest to the road;

a principal beam having forward and rearward edges, a center, and top and bottom faces, said forward and said rearward edges and said center containing binder parts, said rearward edge fixedly attached to said upper vertical part of said L-shaped substructural pile, and said forward edge overhanging the road with a generally upward slope and extending to near a middle of the road; and, a pole having upper and lower ends, said lower end buried in said forward horizontal part of said L-shaped substructural pile and said upper and being fixedly attached to said center of said principal beam.

2. A snow fence as recited in claim 1, further comprising a plurality of said principal beams in abutment, being bound together by laterally clamping materials through said binder parts of at least one of said forward edge, said rearward edge, said center, each of said principal beams being supported at said center by being fixedly attached to said upper end of said poles, with said L-shaped substructural pile being of sufficient length to accommodate the plurality of said principal beams.

3. A snow fence as recited in claim 2, wherein said principal beam is upwardly arced from said rearward edge to said center and downwardly arced from said center to said forward edge, whereby the beam is S-shaped.

4. A snow fence as recited in claim 2, wherein said principal beams each have a rib on said top face thereof, extending from said forward edge to said rearward edge thereof.

5. A snow fence to be disposed along the side of a road and the like, comprising:

an L-shaped substructural pile having a forward horizontal part, a rearward horizontal part, an upper vertical part, and a lower vertical part, said forward horizontal part being closest to the road;

a principal beam, having a top face and a bottom face, a forward edge and a rearward edge, and a center, said bottom face having a rib disposed from said forward edge to said rearward edge, binder parts at said forward and said rearward edges, and between said center and said forward edge, and also between said center and said rearward edge, being fixedly attached at said rearward edge to said upper vertical part of said L-shaped substructural pile, with a generally upward slope and with a section extending from said binder part located between said center and said forward edge to said binder part located at said forward edge having a slight downward arc, and extending to near middle of the road; and, a pole having upper and lower ends, said lower end being buried in said forward horizontal part of said L-shaped substructural pile and said upper end being fixedly attached at said center of said principal beam through said rib.

6. A snow fence as recited in claim 5, further comprising a plurality of said principal beams in abutment, bound together by laterally clamping materials through at least one said binding part, each of said principal beams being supported at said center through said rib by being fixedly attached to said upper end of said poles with said L-shaped substructural pile being of sufficient length to accommodate the plurality of said principal beams.

7. A jet roof to be disposed along the side of a road and the like, comprising:

a foundation pile having a rearward part and a forward part, said forward part being disposed closer to the road;

a plurality of props, said props each having a top end, a bottom end, and a center, said props being fixedly attached at said bottom end to said rearward part of said foundation pile and spaced horizontally along a length of said foundation pile, said props being slightly inclined towards the road;

a plurality of panels having a front facing away from the road, a back facing towards the road, and ends, said ends being fixedly attached between said props in a horizontal disposition and leaving spaces between said panels to form jet openings, said panels being shaped such that said jet openings narrow proceeding towards the road, wherein said panels have a substantially triangular cross section and spaced opposing faces of adjacent ones of the panels converge proceeding towards the road.

8. A jet roof as recited in claim 7, wherein said panels have a rhombic cross section.

9. A jet roof as recited in claim 8, further comprising stay posts, said stay posts having upper and lower ends, said lower ends being buried in said forward part of said foundation pile, said upper ends being fixedly attached to said center of said props.

10. A jet roof as recited in claim 7, wherein said panels have a trapezoidal cross section.

11. A jet roof as recited in claim 10, further comprising stay posts, said stay posts having upper and lower ends, said lower ends being buried in said forward part of said foundation pile, said upper ends being fixedly attached to said center of said props.

12. A jet roof as recited in claim 7, wherein said panels are vertically staggered between said props.

13. A jet roof as recited in claim 12, further comprising stay posts, said stay posts having upper and lower ends, said lower ends being buried in said forward part of said foundation pile, said upper ends being fixedly attached to said center of said props.

14. A jet roof as recited in claim 7, further comprising stay posts, said stay posts having upper and lower ends, said lower ends being buried in said forward part of said foundation pile, said upper ends being fixedly attached to said center of said props.

* * * * *